US005531352A

United States Patent [19]

Kraft et al.

[11] Patent Number: 5,531,352

[45] Date of Patent: Jul. 2, 1996

[54] AGRICULTURAL CONTAINER

[75] Inventors: Larry Kraft, Yakima; Don Holman, Cashmere, both of Wash.

[73] Assignee: Kradon, Inc., Yakima, Wash.

[21] Appl. No.: 89,686

[22] Filed: Jul. 9, 1993

[51] Int. Cl.[6] ..... B65D 19/04

[52] U.S. Cl. ..... 220/675; 220/673; 220/676; 220/608; 220/DIG. 12; 206/599; 206/512; 206/386

[58] Field of Search ..... 264/516; 425/533, 425/546; 206/386, 599, 512, 511, 509; 220/675, 676, 673, 670, 669, 1.5, 608, DIG. 12, DIG. 14

[56] References Cited

U.S. PATENT DOCUMENTS

| | | | |
|---|---|---|---|
| 2,739,734 | 3/1956 | Pugh | 220/83 |
| 3,341,064 | 9/1967 | Ricci | 206/512 |
| 3,403,713 | 10/1968 | Good et al. | 220/675 |
| 3,489,314 | 1/1970 | Slapnik | 220/97 |
| 3,547,309 | 12/1970 | Pusey et al. | 206/504 |
| 3,682,351 | 8/1972 | De Putter | 220/97 B |
| 3,700,137 | 10/1972 | Souza | 220/97 E |
| 3,856,178 | 12/1974 | Norgaard | 220/23.83 |
| 3,902,599 | 9/1975 | Stromberg | 220/675 |
| 3,941,247 | 3/1976 | Cripe | 220/675 |
| 4,015,713 | 4/1977 | Clipson et al. | 206/509 |
| 4,150,496 | 4/1979 | Cloyd | 34/238 |
| 4,197,958 | 4/1980 | Zeni et al. | 220/675 |
| 4,247,004 | 1/1981 | Bird | 206/506 |
| 4,386,700 | 6/1983 | Deaton | 206/507 |
| 4,389,013 | 6/1983 | Hall et al. | 229/45 R |
| 4,474,726 | 10/1984 | Ohta et al. | 264/516 |
| 4,529,088 | 7/1985 | Quong | 206/509 |
| 4,549,672 | 10/1985 | Rinkewich | 220/669 |
| 4,597,503 | 7/1986 | Lates | 220/83 |
| 4,620,644 | 11/1986 | Miller | 220/334 |
| 4,673,087 | 6/1987 | Webb | 206/600 |
| 4,770,292 | 9/1988 | Handler | 220/23.4 |
| 4,848,605 | 7/1989 | Wise | 220/675 |
| 5,071,060 | 12/1991 | DeFelice | 220/675 |
| 5,135,109 | 8/1992 | Vergara | 206/386 |
| 5,161,690 | 11/1992 | Foshaug | 206/512 |
| 5,180,064 | 1/1993 | Elvin-Jensen | 220/675 |

FOREIGN PATENT DOCUMENTS

| | | | |
|---|---|---|---|
| 2494080 | 5/1982 | France | 206/512 |
| 404327129 | 11/1992 | Japan | 220/675 |

OTHER PUBLICATIONS

Hauff, Studies on Apple Bins, Washington State Horticultural Association, 1992.

Waelti, Should We Use Plastic Bins?, Washington State University Tree Fruit Postharvest Journal, 1992.

Palbox Pallets and Containers, Model 110M, Palbox SpA, 1-39044 EGNA (BZ), Italy.

Palbox Pallets and Containers, Models 110, 111 and 113, Palbox SpA, 1-39044 EGNA (BZ), Italy.

*Primary Examiner*—Stephen P. Garbe
*Assistant Examiner*—S. Castellano
*Attorney, Agent, or Firm*—George A. Cashman

[57] ABSTRACT

An agricultural container or fruit bin made of plastic has four vertical walls, triangular corner columns and a bottom element. The exteriors of the vertical walls and bottom element have rectangular rib patterns. Openings in the vertical walls and bottom allow for atmospheric circulation. The upper edges of the sides are bowed inward slightly, and the bottom element has a slight inward dome when the bin is empty.

8 Claims, 9 Drawing Sheets

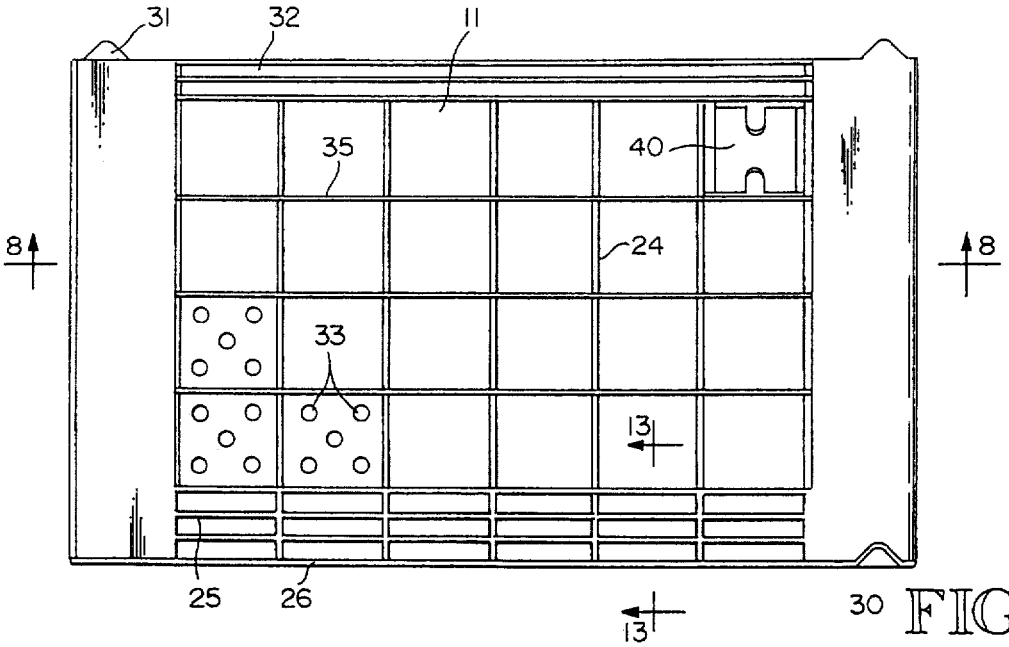
FIG. 3
FIG. 4
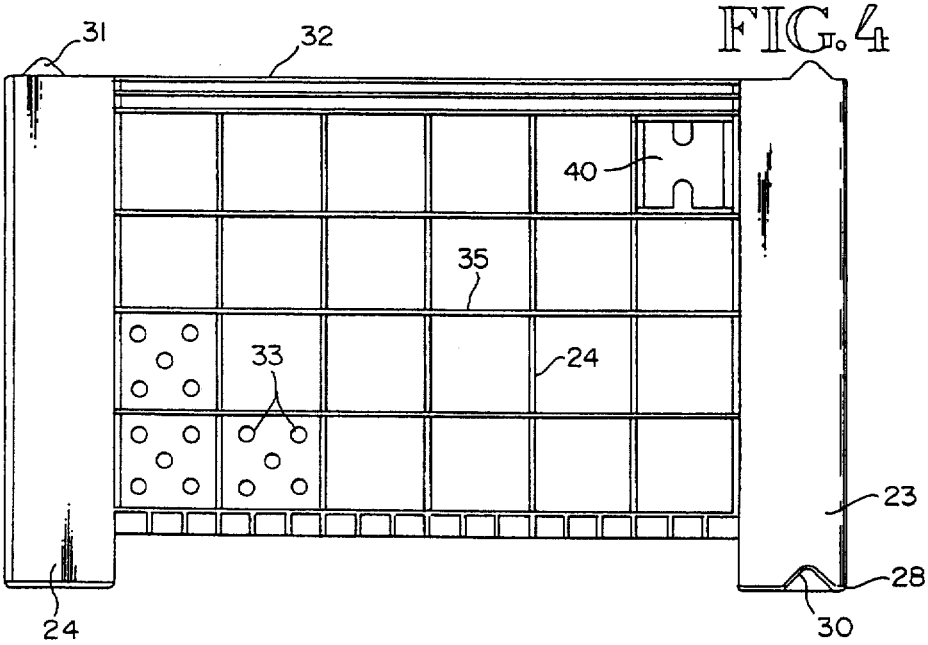
FIG. 13
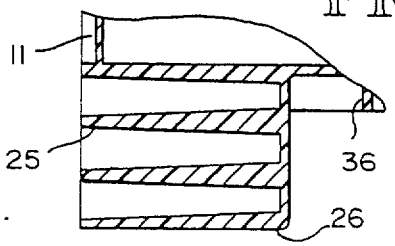
FIG. 14
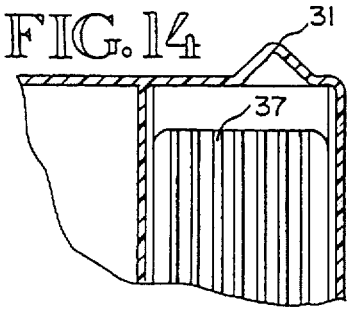

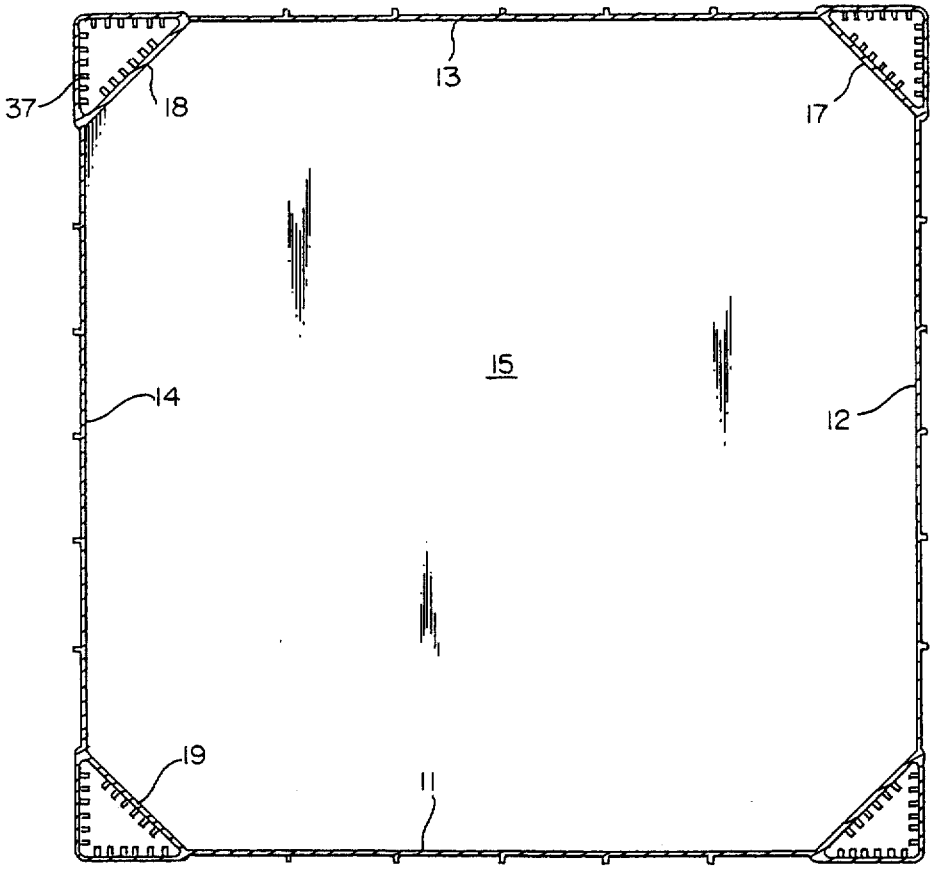
FIG. 8
FIG. 7
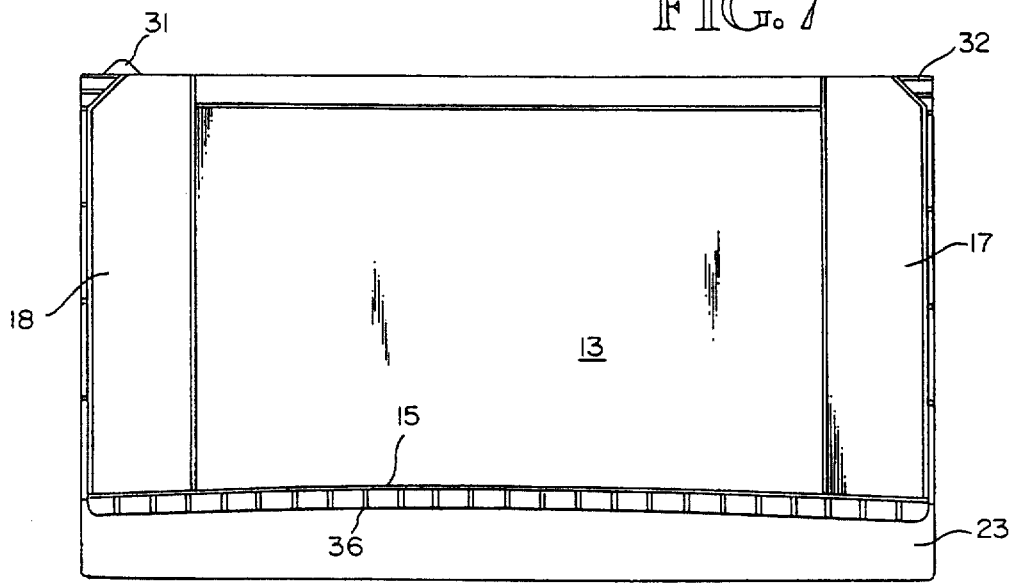

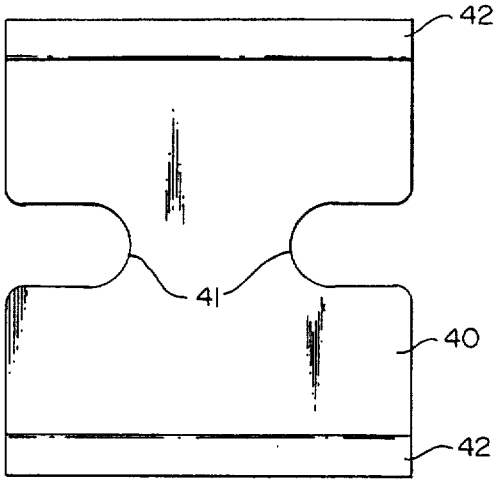
FIG. 16A
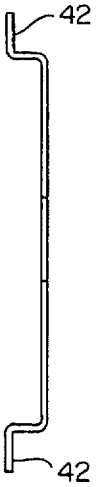
FIG. 16B
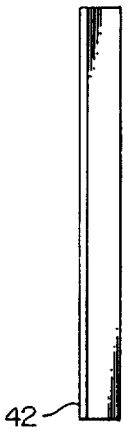
FIG. 16C
FIG. 17
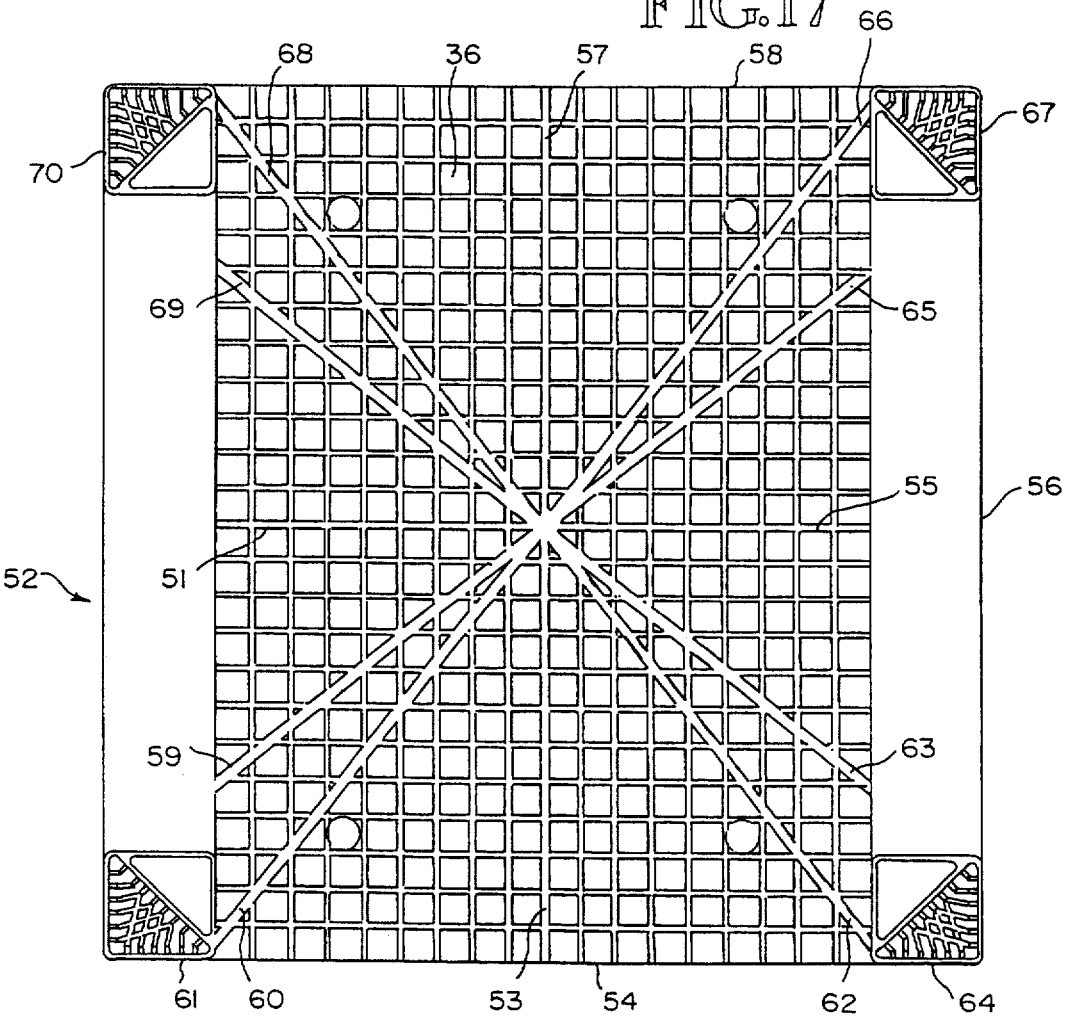

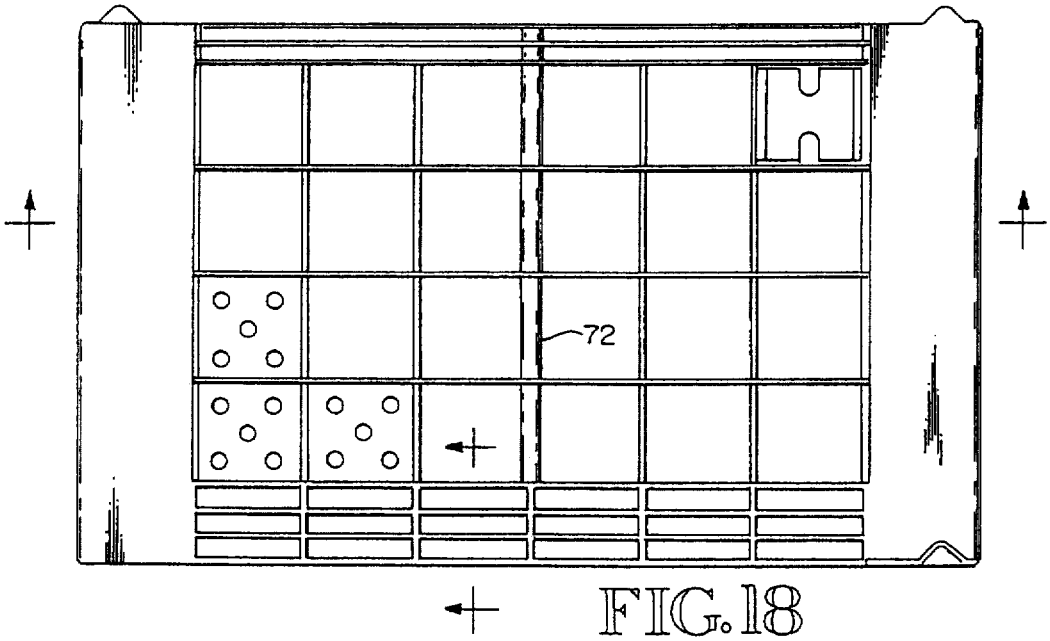
FIG. 18
FIG. 19
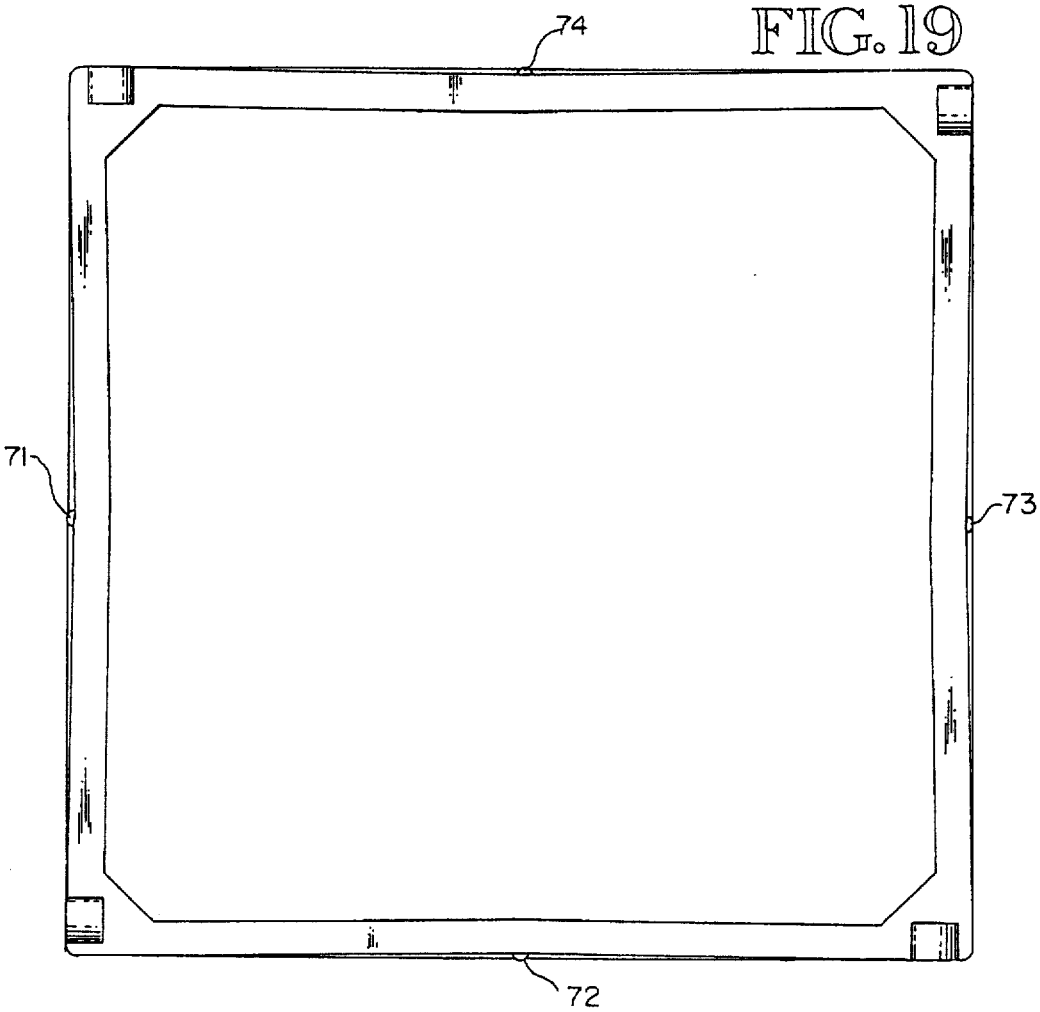

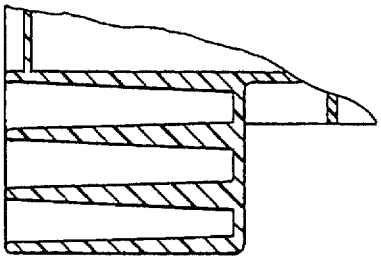
FIG. 20
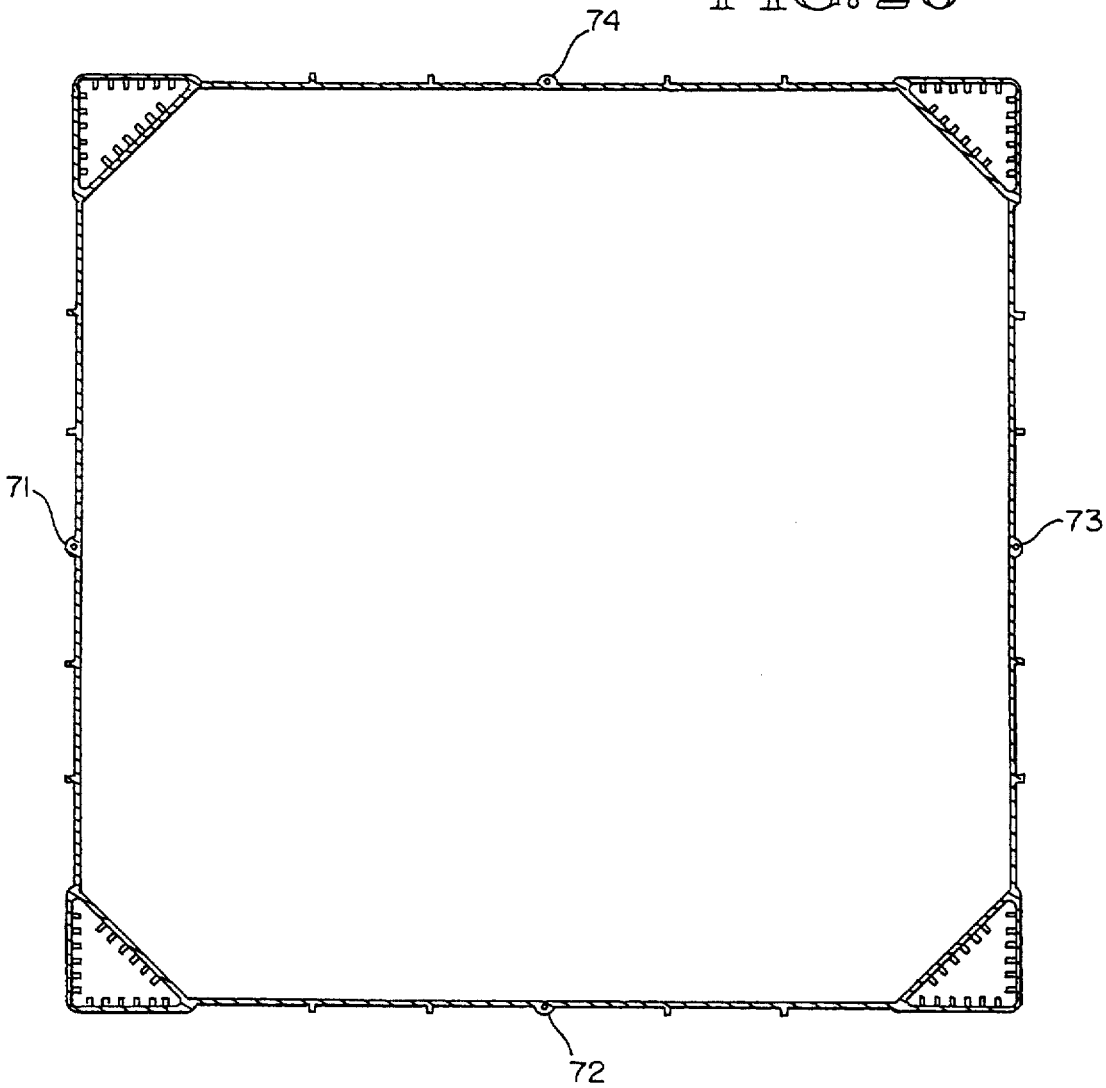

AGRICULTURAL CONTAINER

BACKGROUND OF THE INVENTION

Growers and packers in the apple industry in the Pacific Northwest have standardized on wooden agricultural containers or bins since about 1957. In the orchard, apple pickers place freshly picked apples in the bins. The bins are taken to the packing house where they are sometimes emptied and the contents go through the regular packing process. Other times, the apples are sorted for size and grade and then the bins are refilled and placed in controlled atmosphere storage.

The standard wooden bin has interior dimensions of 47" wide, 47" long and 28½ inches in height. The wooden bins are fastened together with glue, nails, rivets and metal brackets.

Wooden bins suffer from certain disadvantages, such as:

a) Wood construction is subject to cracking and warpage.

b) A single bin may absorb 12 pounds of water during the first three months of controlled atmosphere storage. This moisture comes from the fruit and its loss promotes fruit shrivel.

c) Wood construction does not permit the recommended 8% to 11% free air space on the sides and bottom. This results in slower cooling of the bin contents, and increases difficulty in maintaining low temperatures during controlled atmosphere storage.

d) Wood promotes contamination problems by absorbing chemicals used in orchard and packing house operations.

e) Wood bins are often difficult and time consuming to repair.

f) Most wooden bins lack a bin interlocking feature that would promote stability when the bins are stacked one on another.

g) Wooden bins are not recyclable.

h) Dry wooden bins create fire hazards in bin storage areas.

The advantages of a plastic bin are:

a) Plastic does not absorb moisture which assists in the control of humidity during storage and enhances fruit quality.

b) With at least 10% free air space in the sides and bottom, the plastic bin allows faster cooling in storage, and assists in maintaining uniform low temperatures in the storage building.

c) Smooth interior wall and floor surfaces permit easy cleaning and reduce the potential for contamination caused by decay organisms which often are present in wood bins.

d) A molded interlocking feature permits safer storage and transport of vertically stacked bins.

e) The plastic can be recycled into new bins.

All of the above disadvantages of wooden bins and advantages of plastic bins are set forth in 'STUDIES ON APPLE BINS' by Dr. Alan F. Hauff, published by the Washington State Horticultural Association.

BRIEF DESCRIPTION OF THE INVENTION

This invention comprises a plastic agricultural container or fruit bin of rectangular shape, having four sides and a bottom. In plan view, the corners are triangular in shape for added strength. The upper edges of the sides are bowed inward slightly, and the bottom is formed as a shallow dome with the peak upward. When the bin is fully loaded with fruit, the pressure of the load causes the sides and bottom to become planar, so that adjoining sides are perpendicular to each other and the bottom is flat. The sides and bottom are formed with ribs on the outside. On two opposite sides, the lower edges of the sides are continuous for the width of the corner triangle, forming solid support for the bin. These bottom portions extend below the bottom of the bin a sufficient distance to allow for the insertion of the forks of a fork lift truck. The top edge of each of the four walls, except for the triangular corner areas, has an undercut lip for easy handling of the bin. As originally molded, the bottom of each corner is open, but a cap having ribbed projecting walls is inserted into the opening and pressed into place. At each upper corner there is a projection, triangular in cross-section. The lower caps have an indentation, triangular in cross-section, into which the upper projections fit when the bins are stacked one on another. This provides stacking stability, which is not present in most of the wooden bins now in use.

The triangular columns forming the corners are ribbed on the inside for stability, which is needed when the loaded bins are stacked, possibly thirteen bins high.

In the flat area between the ribs on the side walls, openings are provided for air movement, which aids in rapid cooling of the fruit. The openings may be longitudinal slots, or may be round holes. Similar openings are provided in the bottom to aid in air circulation through the fruit load.

In another embodiment of the bin, gas injection tubes may be molded into the rib area on the lower side of the bottom, and may continue up the side walls.

BRIEF DESCRIPTION OF THE DRAWINGS

FIG. 3 is a front elevation view of the bin.

FIG. 4 is a side elevation view of the bin.

FIG. 7 is a sectional view taken at line 7—7 of FIG. 5.

FIG. 8 is a sectional view taken at line 8—8 of FIG. 3.

FIG. 13 is a sectional view taken at line 13—13 of FIG. 3.

FIG. 14 is a sectional view taken at line 14—14 of FIG. 5.

FIG. 16A illustrates a plan view of the packing ticket holder.

FIG. 16B illustrates an elevation view of the packing ticket holder.

FIG. 16C illustrates a bottom view of the packing ticket holder.

FIG. 17 is a view of the bottom of the second embodiment showing gas injection tube locations.

FIG. 18 is a view of the front of the second embodiment showing a gas injection tube on a front wall of the bin.

FIG. 19 is a plan view of the second embodiment of the bin showing the location of gas injection tubes on the vertical walls.

FIG. 20 is a sectional plan view of the second embodiment showing gas injection tube locations on the vertical walls.

DETAILED DESCRIPTION OF THE INVENTION

Figure 1:
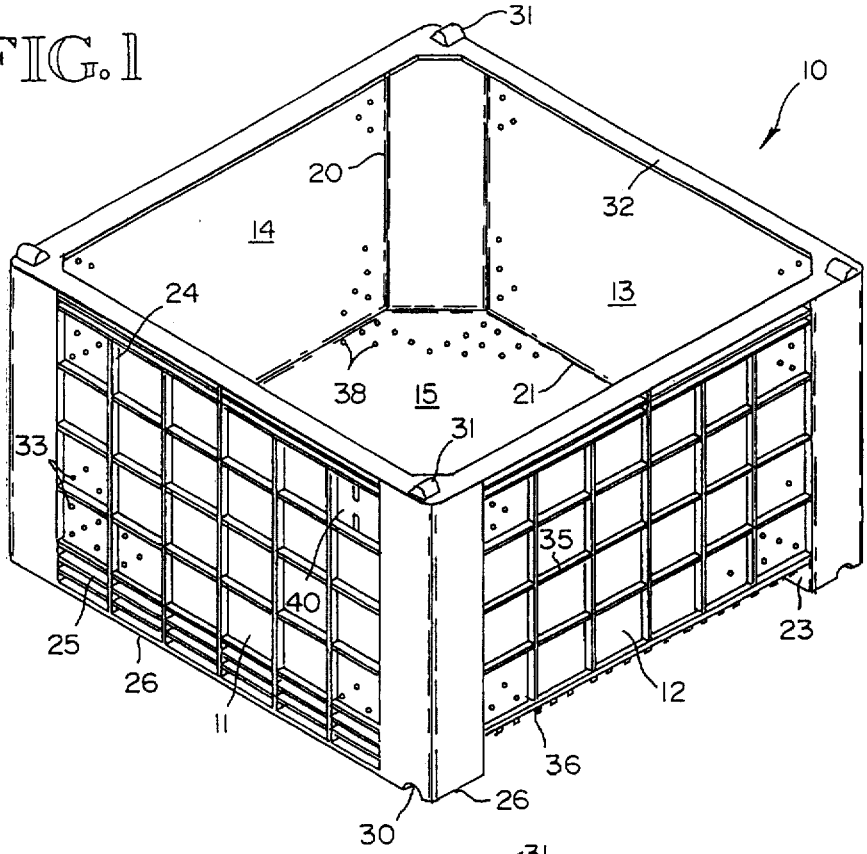
FIG. 1 is a perspective view of the bin as viewed from above.
Figure 2:
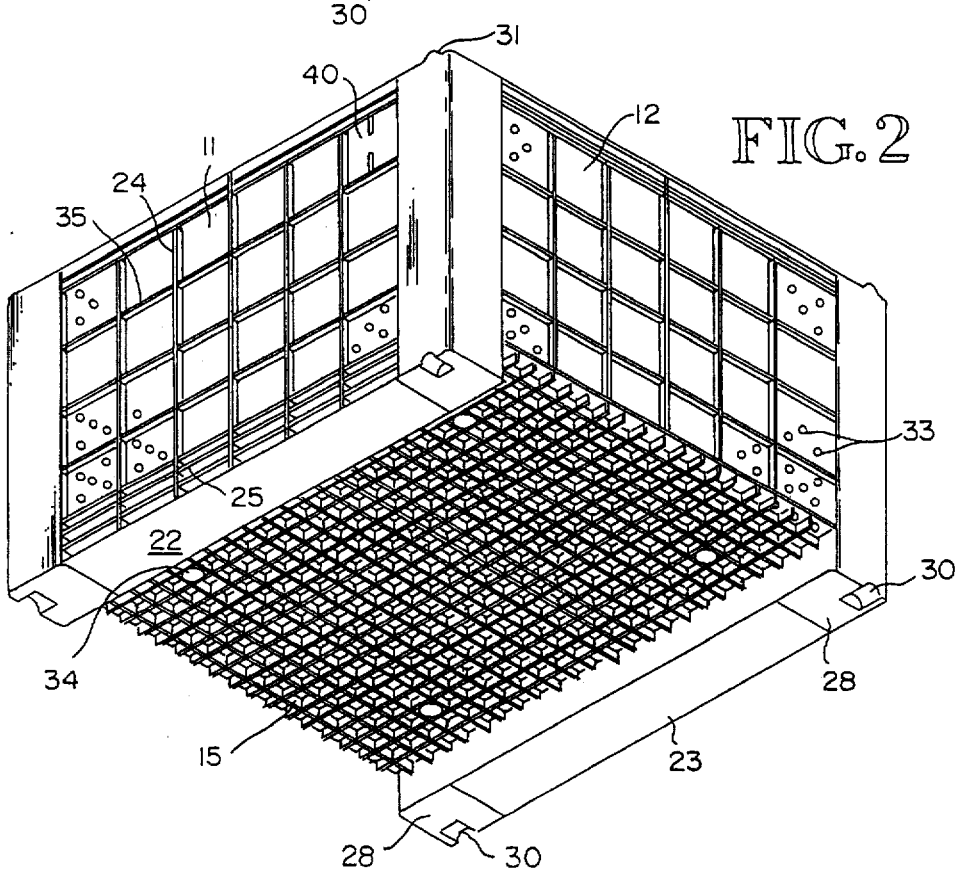
FIG. 2 is a perspective view of the bin as viewed from below.

The fruit bin of this invention may be made of either high density polyethylene or rigid polyvinyl chloride (PVC). In either case, an ultra-violet inhibitor would be added to the mix before molding. The bin may be produced in various colors, for example, white, gray or green.

The fruit bin is indicated generally as 10. There is a front wall 11, a side wall 12, a rear wall 13, a side wall 4 and a bottom 15. The interior surfaces of walls 11, 12, 13 and 14 and of the bottom 15 are smooth. The exterior surfaces of walls 11, 12, 13 and 14 are molded with a rectangular rib pattern, the ribs being perpendicular to each other, each of the vertical ribs 24 and each of the horizontal ribs 35 being spaced several inches apart. The exterior of bottom 15 is molded with a rectangular rib pattern, the ribs 36 being perpendicular to each other and being spaced more closely than the ribs on the walls.

Walls 11, 2, 13 and 14 are joined by triangular elements. Triangular element 16 joins walls 11 and 12. Triangular element 17 joins walls 12 and 13. Triangular element 18 joins walls 13 and 4. Triangular element 19 joins walls 14 and 11. The joint between each triangular element and each wall is rounded, as shown by 20 in FIG. 1. The joint between each wall and each triangular element and bottom 15 is rounded, as shown by 2 in FIG. 1.

Figure 6:
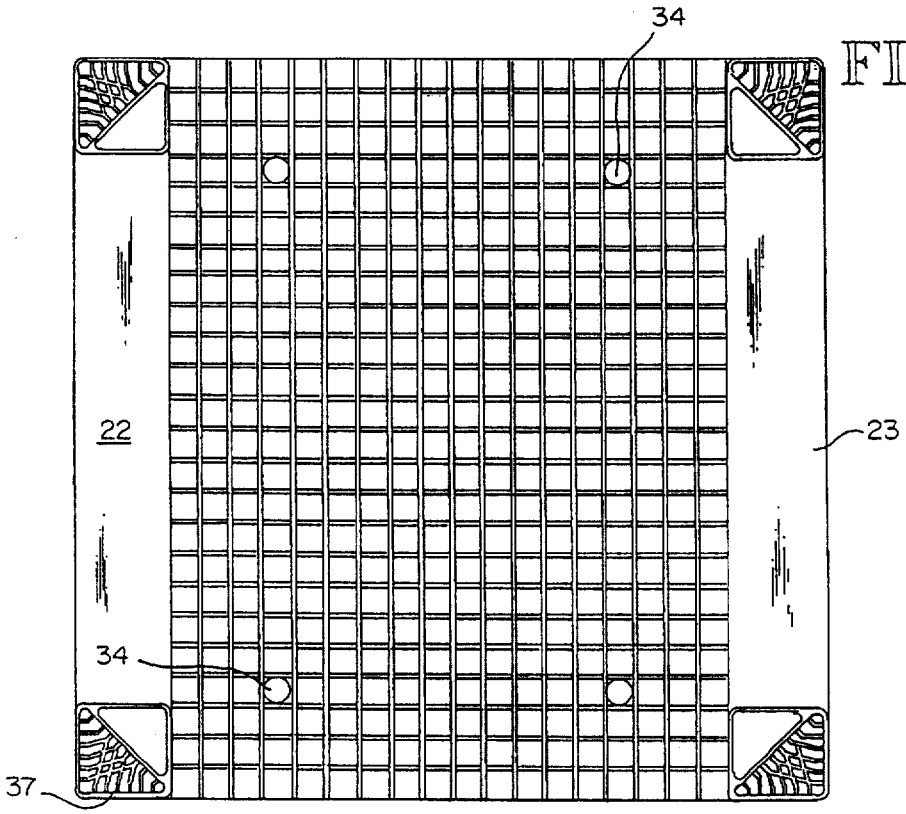
FIG. 6 is a view of the bottom of the bin.
Figure 10:
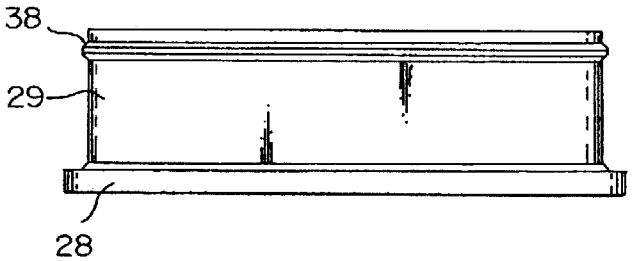
FIG. 10 is an elevation view of a closure cap.
Figure 11:
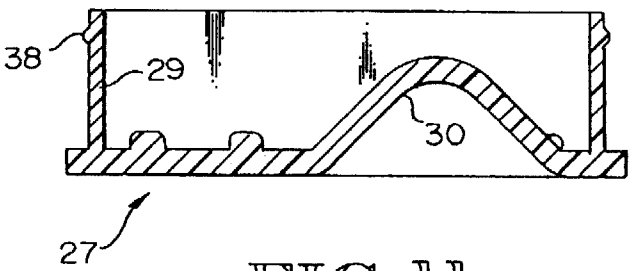
FIG. 11 is a sectional view of a closure cap taken at line 11—11 of FIG. 9.

Each triangular element 6, 17, 18 and 19 has longitudinal ribs 37 molded into the interior of the element, as can be seen in FIG.6. The ribs 37 do not extend all the way to the bottom of the triangular elements. The ribs 37 are shortened to allow a cap (described below) to be pressed into place.

Support for the bin is formed under front wall 11 and back wall 13. A box shaped element 22 extends the length of front wall 1. The height of the box shape is sufficiently below bottom 5 to allow for insertion of the forks of a fork lift truck, with room to spare. The width of the box shape is approximately that of one of the perpendicular legs of each triangular element. A similar box shaped element 23 underlies back wall 13. It will be noted that the box shaped elements 22 and 23 are not completely enclosed. The vertical ribs 24 on front wall 11 and back wall 13 are continued downward. Horizontal ribs 25 are molded, with the lowermost rib forming the bottom 26 of each box-shaped element.

In forming the bin 10, the bottom of each corner is left open. These openings are closed with a cap 27. Each cap 27 is identical. There is a plate 28 corresponding in size to the opening and the thickness of the plastic forming the corners. A wall 29 extends upward from the plate, the wall 29 having the shape of the opening itself. A rib 38 is formed around wall 29 near the free end of the wall 29. The cap is pressed into place to close the opening. Plate 28 has an indentation 30 which is approximately triangular in cross section. The length of indentation 30 is approximately ⅜ of the width of plate 28. It will be noted, particularly in FIG. 1, that there is a projection 31, triangular in cross section projecting upward from each corner of the upper surface of bin 10. When the bins 10 are stacked one on another, projection 31 of one bin fits into indentation 30 of the bin directly above it. This provides stability when the bins are stacked as many as thirteen bins high.

Along the upper edge of each wall 11, 2, 13 and 14 is an inward-extending lip 32 which terminates where the lip 32 meets a triangular corner section. The purposes of lip 32 are to strengthen the walls, provide more stable stacking and to use as a handhold when moving empty bins.

Figure 5:
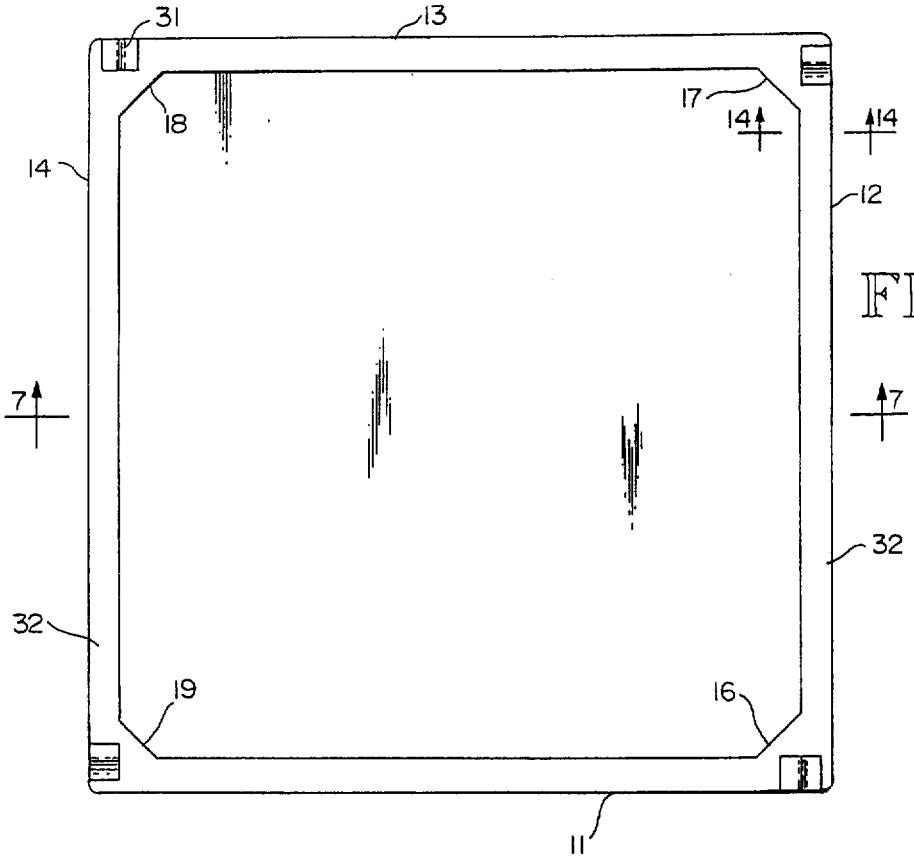
FIG. 5 is a plan view of the bin.

It will be noted, particularly in FIG. 5, that the upper edges of the walls 11, 12, 13 and 14 are bowed inward slightly. It will also be noted in FIG. 7 that the bottom forms a very shallow dome oriented inwardly. The purpose of the bowing and the dome is to allow the weight of the fruit to move the walls outward, and the bottom downward, so that the walls and bottom become planar. This prevents crushing the fruit when the loaded bins are lifted and stacked.

In the planar portions between the ribs on walls 11, 12, 13 and 14 there are openings 33 to allow the circulation of air through the bins to cool the fruit. Openings 38 are also provided in the bottom of the bin to assist in cooling. This is particularly important when loaded bins are placed in storage. If the fruit is cooled rapidly, the fruit will stay in better condition. In addition, good air circulation through the bins assists in maintaining the proper temperature during storage.

Cylindrical rubber bumpers 34 are placed into some of the square rib spaces on bottom 15. The bumpers extend about ⅛ inch below the ribs on the lower surface of bottom 15. The purpose of bumpers 34 is to engage the upper surface of the steel forks of fork lift trucks. If bumpers 34 were not used, there might be a tendency for the plastic bin to slide on the steel surface of the forks.

FIGS. 16A, 16B, and 16C illustrates a clear, flexible, plastic packing ticket holder 40 which is inserted into a rib space on the side of the bin. Holder 40 has finger indentations 41 and flanges 42 which engage vertical elements of the bin.

A second embodiment of the agricultural container or fruit bin utilizes gas injection tubes which assist in insuring full flow of the plastic in the mold. The bin of the second embodiment is the same size as the bin of the first embodiment, and has the same features, including the four vertical walls, the bottom element, the rib pattern, the air circulation openings and the slightly bowed-in sides and the slightly domed bottom. FIG. 17 which is a view of the bottom of the bin best illustrates the orientation of the gas injection tubes. The tubes are formed within the grid pattern on the lower side of bottom element 50. Tube 51 serves side 52, and tube 53 serves side 54. Tube 55 serves side 56, and tube 57 serves side 58. Tubes 59 and 60 serve corner element 6. Tubes 62 and 63 serve corner element 64. Tubes 65 and 66 serve corner element 67. Tubes 68 and 69 serve corner element 70.

Figure 9:
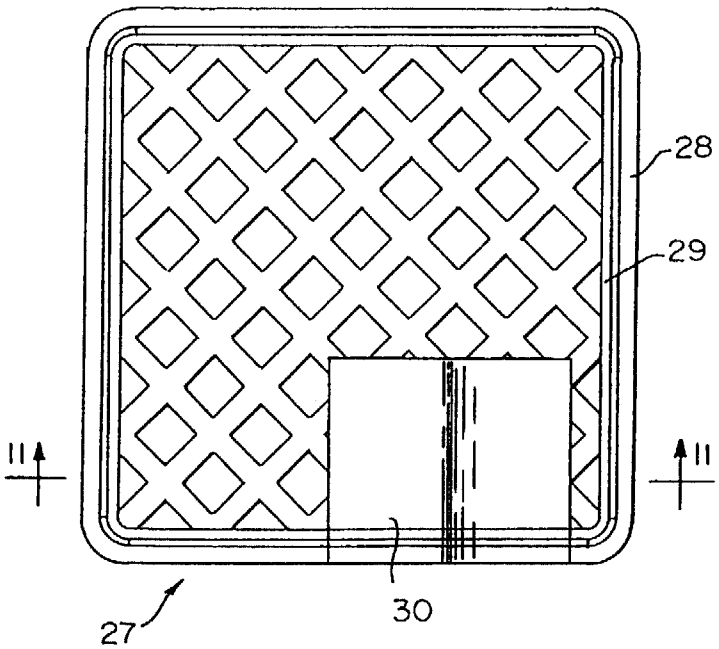
FIG. 9 is a plan view of a closure cap for a corner element.
Figure 12:
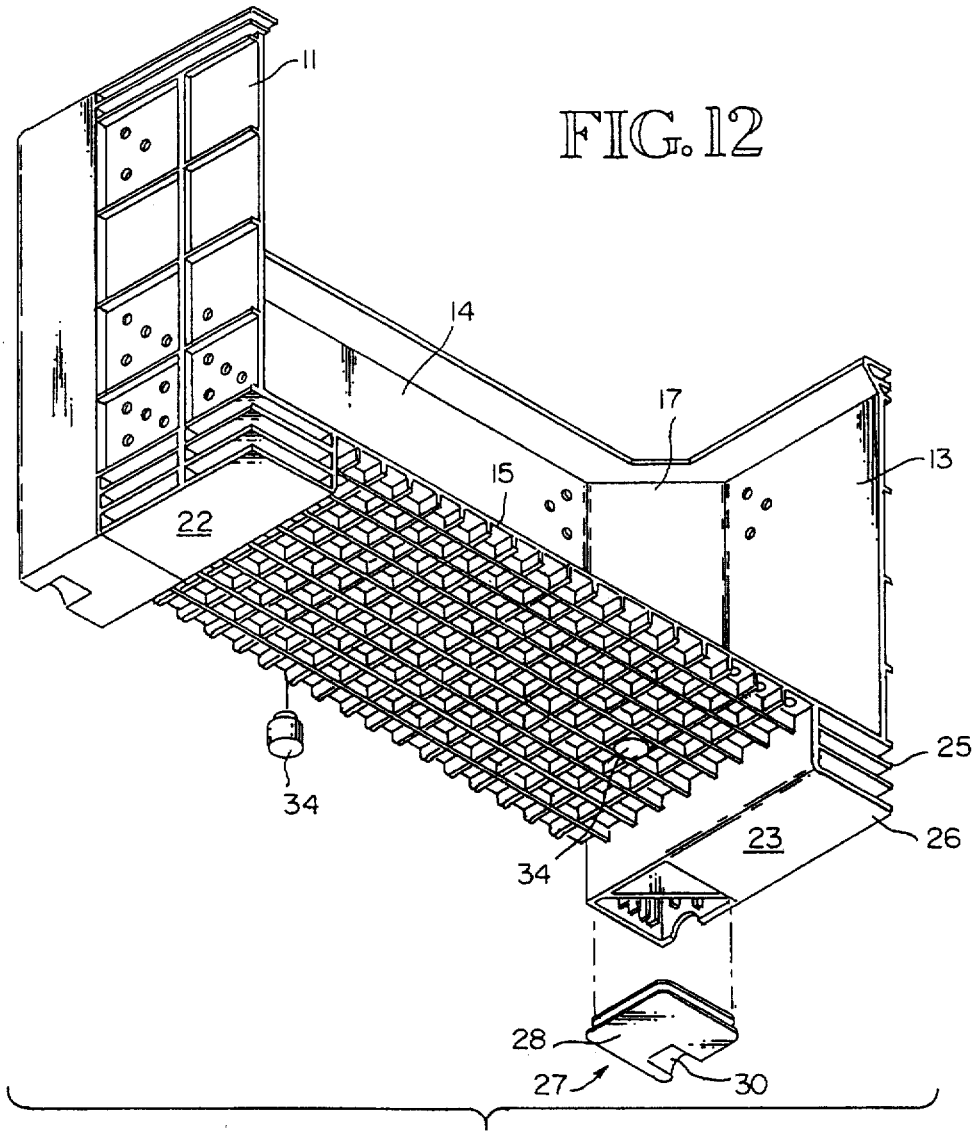
FIG. 12 is a sectional perspective view of the bin showing a closure cap and showing rubber bumpers inserted into the bottom grid.
Figure 15A:
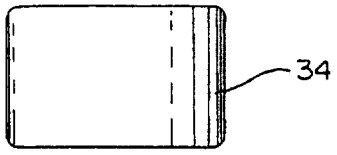
FIG. 15A illustrates an elevation view of a rubber bumper which is inserted into the rib section on the lower side of the bottom element.
Figure 15B:
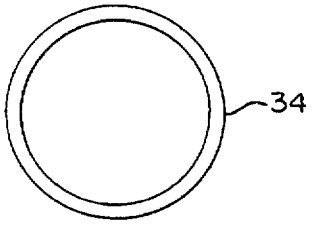
FIG. 15B illustrates a plan view of a rubber bumper which is inserted into the rib section on the lower side of the bottom element.

In FIG. 8, vertical gas injection tube 72 is a continuation of tube 53. In the plan view shown in FIG. 9, tube 71 is a continuation of tube 55. Tube 73 is a continuation of tube 51, and tube 74 is a continuation of tube 57.

While this invention is susceptible of embodiment in different forms, the drawings and the specification illustrate the preferred embodiment and a second embodiment of the invention, with the understanding that the present disclosure is to be considered an exemplification of the principles of the invention, and the disclosure is not intended to limit the invention to the particular embodiments described.

We claim:

1. A plastic fruit bin comprising:

four vertical walls forming, in plan view, a rectangular shape;

a bottom element joined to the four vertical walls;

two support elements, each extending along and attached to the bottom of each of two opposite walls and partly supporting and extending below the bottom element; and an array of gas injection tubes disposed on the lower side of the bottom element and extending up the center of each of the four vertical walls.

2. The bin of claim 1 wherein the vertical walls are joined to each other at their ends by a triangular shaped column, each of said columns forming a corner of the bin, and said columns being stiffened internally with longitudinal ribs.

3. The bin of claim 2 wherein the inside of the bin is smooth and the joints between the walls, the triangular columns and the bottom element are rounded.

4. The bin of claim 1 wherein the exterior of the vertical walls and the lower side of the bottom element have a rectangular rib pattern formed thereon.

5. The bin of claim 3 wherein the planar spaces within the rib patterns of the vertical walls and the bottom element are provided with openings for atmospheric circulation.

6. The bin of claim 4 wherein a plurality of rubber plugs is inserted into spaces in that rib pattern on the lower side of the bottom element.

7. The bin of claim 1 wherein the upper portions of the vertical walls are bowed slightly inward, and the center of the bottom element is bowed slightly upward.

8. The bin of claim 2 wherein recesses are formed at the lower end of each corner column, and matching projections are formed at the upper end of each corner column.

* * * * *

UNITED STATES PATENT AND TRADEMARK OFFICE

CERTIFICATE OF CORRECTION

PATENT NO. : 5,531,352

DATED : July 2, 1996

INVENTOR(S) : Larry Kraft, et al.

It is certified that error appears in the above-indentified patent and that said Letters Patent is hereby corrected as shown below:

Column 3, line 28, replace the numeral "4" with --14--;

Column 3, line 38, replace the numeral "2" with --12--;

Column 3, line 41, replace the numeral "4" with --14--;

Column 3, line 43, replace the numeral "2" with --21--;

Column 3, line 46, replace the numeral "6" with --16--;

Column 3, line 54, replace the numeral "1" with --11--;

Column 3, line 55, replace the numeral "5" with --15--;

Column 4, line 15, replace the numeral "2" with --12--;

Column 4, line 61, replace the numeral "6" with --61--;

Column 4, line 64, replace the numeral "8" with --18--; and

Column 4, line 65, replace the numeral "9" with --19--.

Signed and Sealed this

Tenth Day of September, 19

Bruce Lehman

*Attest:*

BRUCE LEHMAN

*Attesting Officer*

*Commissioner of Patents and Trademarks*